US011518650B2

(12) United States Patent
Witczak et al.

(10) Patent No.: US 11,518,650 B2
(45) Date of Patent: Dec. 6, 2022

(54) VARIABLE THRESHOLDS FOR AN ELEVATOR SYSTEM

(71) Applicant: Otis Elevator Company, Farmington, CT (US)

(72) Inventors: Tadeusz Pawel Witczak, Farmington, CT (US); Craig Drew Bogli, Avon, CT (US); Ezhil Nanjappan, Farmington, CT (US); Derk Oscar Pahlke, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 1210 days.

(21) Appl. No.: 16/009,292

(22) Filed: Jun. 15, 2018

(65) Prior Publication Data

US 2019/0382239 A1 Dec. 19, 2019

(51) Int. Cl.
*B66B 5/00* (2006.01)
*B66B 1/28* (2006.01)
(Continued)

(52) U.S. Cl.
CPC ..... *B66B 5/0037* (2013.01); *B66B 1/28* (2013.01); *B66B 1/3407* (2013.01); *B66B 3/00* (2013.01);
(Continued)

(58) Field of Classification Search
CPC ... B66B 5/0018; B66B 5/0025; B66B 5/0037; B66B 1/3492; B66B 2201/402;
(Continued)

(56) References Cited

U.S. PATENT DOCUMENTS 4,512,442 A * 4/1985 Moore ..... B66B 5/0037 187/393
7,143,001 B2 11/2006 Karasek
(Continued)

FOREIGN PATENT DOCUMENTS

CN 202267861 U 6/2012
CN 102923538 A 2/2013
(Continued)

OTHER PUBLICATIONS

Chinese Office Action; dated Apr. 15, 2021; Application No. 201910516356.3; Filed: Jun. 14, 2019; 8 pages.
(Continued)

*Primary Examiner* — Marlon T Fletcher
(74) *Attorney, Agent, or Firm* — Cantor Colburn LLP

(57) ABSTRACT

A method for monitoring thresholds for performance attributes in an elevator system is provided. Aspects includes collecting, by a sensor affixed to an elevator car, sensor data associated with the elevator system wherein the sensor data comprises one or more performance attribute values for a set of performance attributes of the elevator system. Obtaining a threshold profile associated with the elevator system, wherein the threshold profile comprises thresholds for each performance attribute in the set of performance attributes of the elevator system. Comparing the one or more performance attribute values to corresponding thresholds for the set of performance attributes and transmitting an alert for any of the one or more performance attribute values exceeding the corresponding thresholds for the set of performance attributes.

18 Claims, 5 Drawing Sheets

(51) Int. Cl.

| | |
|---|---|
| ***B66B 1/34*** | (2006.01) |
| ***B66B 3/00*** | (2006.01) |
| ***B66B 5/02*** | (2006.01) |
| ***B66B 9/00*** | (2006.01) |
| ***B66B 13/14*** | (2006.01) |

(52) U.S. Cl.
CPC ..... *B66B 5/0018* (2013.01); *B66B 5/02* (2013.01); *B66B 9/00* (2013.01); *B66B 13/143* (2013.01)

(58) Field of Classification Search
CPC ..... B66B 5/02; B66B 5/0006; B66B 5/0087; B66B 5/00; B66B 25/006; B66B 13/00; B66B 2201/212; B66B 13/22; B66B 7/1223; B66B 7/123; B66B 7/1207
See application file for complete search history.

(56) References Cited

U.S. PATENT DOCUMENTS

| | | | | |
|---|---|---|---|---|
| 7,344,004 | B2 | 3/2008 | Engel et al. | |
| 9,747,585 | B2 | 8/2017 | Eleid et al. | |
| 9,767,441 | B2 | 9/2017 | Eleid et al. | |
| 2015/0158699 | A1 | 6/2015 | Haapaniemi et al. | |
| 2015/0284214 | A1 | 10/2015 | Park et al. | |
| 2017/0029244 | A1* | 2/2017 | Madarasz | B66B 5/0037 |
| 2018/0086597 | A1 | 3/2018 | Song et al. | |
| 2018/0332368 | A1* | 11/2018 | Copeland | B66B 27/00 |
| 2019/0382237 | A1* | 12/2019 | Witczak | B66B 1/3492 |
| 2019/0382239 | A1* | 12/2019 | Witczak | B66B 9/00 |

FOREIGN PATENT DOCUMENTS

| | | | | | |
|---|---|---|---|---|---|
| CN | 204280939 | U | | 4/2015 | |
| CN | 204454130 | U | | 7/2015 | |
| CN | 204737522 | U | | 11/2015 | |
| CN | 105731209 | A | | 7/2016 | |
| CN | 106429689 | A | | 2/2017 | |
| CN | 206407771 | U | | 8/2017 | |
| CN | 206466834 | U | | 9/2017 | |
| CN | 206538062 | U | | 10/2017 | |
| CN | 107572334 | A | | 1/2018 | |
| CN | 107826917 | A | | 3/2018 | |
| CN | 2007090715 | U | | 3/2018 | |
| CN | 107934710 | A | | 4/2018 | |
| CN | 107934711 | A | | 4/2018 | |
| CN | 108689271 | A | * | 10/2018 | B66B 5/0025 |
| CN | 107572334 | B | * | 6/2019 | |
| CN | 110167862 | B | * | 3/2021 | B66B 7/1207 |
| EP | 0146412 | A2 | * | 6/1985 | |
| EP | 0148000 | A1 | * | 7/1985 | |
| EP | 0450766 | A2 | * | 10/1991 | |
| EP | 1353868 | A1 | | 5/2002 | |
| EP | 3048074 | A1 | * | 7/2016 | B66B 1/304 |
| EP | 3287405 | A1 | | 2/2018 | |
| EP | 3293137 | A1 | * | 3/2018 | |
| EP | 3581534 | A1 | * | 12/2019 | B66B 1/06 |
| EP | 3581534 | A1 | | 12/2019 | |
| KR | 20140106686 | A | * | 9/2014 | |
| KR | 20170075267 | A | | 7/2017 | |
| WO | 2017055176 | A1 | | 4/2017 | |
| WO | WO-2018166994 | A1 | * | 9/2018 | B66B 5/0031 |

OTHER PUBLICATIONS

European Office Action; dated Apr. 8, 2021; Application No. 19180699.1; Filed: Jun. 17, 2019; 7 pages.
Chinese Office Action; dated Aug. 28, 2020; Chinese Application No. 201910516356.3; Filed: Jun. 14, 2019; 11 pages.
European Search Report; dated Oct. 30, 2019; European Application No. 19180699.1; Filed: Jun. 17, 2019; 10 pages.

* cited by examiner

FIG. 4

400

402

| From / To | 1st floor | 2nd floor | 3rd floor | 4th floor | 5th floor |
|---|---|---|---|---|---|
| 1st floor | n/a | 15 sec (+/-500ms) | 21 sec (+/- 500ms) | 27 sec (+/- 500ms) | 33 sec (+/- 500ms) |
| 2nd floor | 18 sec (+/- 500ms) | n/a | 10 sec (+/- 500ms) | 16 sec (+/- 500ms) | 22 sec (+/- 500ms) |
| 3rd floor | 25 sec (+/- 500ms) | 10 sec (+/- 100ms) | n/a | 10 sec (+/- 500ms) | 16 sec (+/- 500ms) |
| 4th floor | 31 sec (+/- 200ms) | 16 sec (+/- 50ms) | 10 sec (+/- 500ms) | n/a | 10 sec (+/- 500ms) |
| 5th floor | 33 sec (+/- 500ms) | 22 sec (+/- 100ms) | 16 sec (+/- 500ms) | 10 sec (+/- 500ms) | n/a |

404

VARIABLE THRESHOLDS FOR AN ELEVATOR SYSTEM

BACKGROUND

The subject matter disclosed herein generally relates to elevator systems and, more particularly, to variable thresholds for an elevator system.

Typically, sensor-based elevator performance monitoring includes a set of specific tolerance thresholds for determining the status and performance of the elevator. This sensor data can be utilized for performing periodic and non-scheduled maintenance to address issues before an interruption in elevator service occurs. The specific tolerance thresholds are often set arbitrarily or in a one size fits all approach for each floor when, in fact, each floor can be different in terms of performance attributes for the elevator car at that specific floor.

BRIEF DESCRIPTION

According to one embodiment, a method is provided. The method includes collecting, by a sensor affixed to an elevator car, sensor data associated with the elevator system wherein the sensor data comprises one or more performance attribute values for a set of performance attributes of the elevator system. Obtaining a threshold profile associated with the elevator system, wherein the threshold profile comprises thresholds for each performance attribute in the set of performance attributes of the elevator system. Comparing the one or more performance attribute values to corresponding thresholds for the set of performance attributes and transmitting an alert for any of the one or more performance attribute values exceeding the corresponding thresholds for the set of performance attributes.

In addition to one or more of the features described above, or as an alternative, further embodiments of the method may include that the thresholds for each performance attribute varies based on a floor location of the elevator system.

In addition to one or more of the features described above, or as an alternative, further embodiments of the method may include storing, in a memory, the sensor data and periodically, analyzing the stored sensor data to update the threshold profile.

In addition to one or more of the features described above, or as an alternative, further embodiments of the method may include that analyzing the stored sensor data to update the threshold profile comprises applying a learning algorithm to the stored sensor data to extract updated thresholds for each of the set of performance attributes and storing the updated thresholds in the threshold profile.

In addition to one or more of the features described above, or as an alternative, further embodiments of the method may include that the thresholds comprise a range of values for each of the set of performance attributes of the elevator car.

In addition to one or more of the features described above, or as an alternative, further embodiments of the method may include that the thresholds comprise a single value for each of the set of performance attributes of the elevator car.

In addition to one or more of the features described above, or as an alternative, further embodiments of the method may include that the alert includes any of the one or more performance attribute values exceeding the corresponding thresholds for the set of performance attributes and the corresponding thresholds.

In addition to one or more of the features described above, or as an alternative, further embodiments of the method may include that the alert is transmitted to an elevator maintenance system.

In addition to one or more of the features described above, or as an alternative, further embodiments of the method may include causing an action for the elevator car to occur based at least in part on any of the one or more performance attribute values exceeding the corresponding thresholds for the set of performance attributes.

In addition to one or more of the features described above, or as an alternative, further embodiments of the method may include that the action comprises altering an operation of the elevator car.

In addition to one or more of the features described above, or as an alternative, further embodiments of the method may include that at least one of the set of performance attributes includes travel time for an elevator car in the elevator system.

In addition to one or more of the features described above, or as an alternative, further embodiments of the method may include that at least on one of the set of performance attributes includes elevator system door vibration and further comprising collecting, by the sensor, vibration values associated with an elevator car in the elevator system. Comparing the vibration values to a threshold from the threshold profile and adjusting an opening speed for an elevator system door based at least in part on the vibration values exceeding the threshold.

According to one embodiment, an elevator system is provided. The elevator system includes an elevator car, a sensor affixed to the elevator car, wherein the sensor is operated by a controller. The controller is configured to collect, by the sensor, sensor data associated with the elevator system, wherein the sensor data comprises one or more performance attribute values for a set of performance attributes of the elevator system. Obtain a threshold profile associated with the elevator system, wherein the threshold profile comprises thresholds for each performance attribute in the set of performance attributes of the elevator system. Compare the one or more performance attribute values to corresponding thresholds for the set of performance attributes and transmit an alert for any of the one or more performance attribute values exceeding the corresponding thresholds for the set of performance attributes.

In addition to one or more of the features described above, or as an alternative, further embodiments of the system may include that the thresholds for each performance attribute varies based on a floor location of the elevator system.

In addition to one or more of the features described above, or as an alternative, further embodiments of the system may include that the controller is further configured to store, in a memory, the sensor data and periodically, analyze the stored sensor data to update the threshold profile.

In addition to one or more of the features described above, or as an alternative, further embodiments of the system may include that analyzing the stored sensor data to update the threshold profile comprises applying a learning algorithm to the stored sensor data to extract updated thresholds for each of the set of performance attributes and storing the updated thresholds in the threshold profile.

In addition to one or more of the features described above, or as an alternative, further embodiments of the system may include that the thresholds comprise a range of values for each of the set of performance attributes of the elevator car.

In addition to one or more of the features described above, or as an alternative, further embodiments of the system may include that the thresholds comprise a single value for each of the set of performance attributes of the elevator car.

In addition to one or more of the features described above, or as an alternative, further embodiments of the system may include that the alert includes any of the one or more performance attribute values exceeding the corresponding thresholds for the set of performance attributes and the corresponding thresholds.

In addition to one or more of the features described above, or as an alternative, further embodiments of the system may include that wherein the alert is transmitted to an elevator maintenance system.

BRIEF DESCRIPTION OF THE DRAWINGS

The present disclosure is illustrated by way of example and not limited in the accompanying figures in which like reference numerals indicate similar elements.

FIG. 4 depicts a threshold profile 400 including thresholds for floor origin-destination pairs according to one or more embodiments of the disclosure.

DETAILED DESCRIPTION

Figure 1:
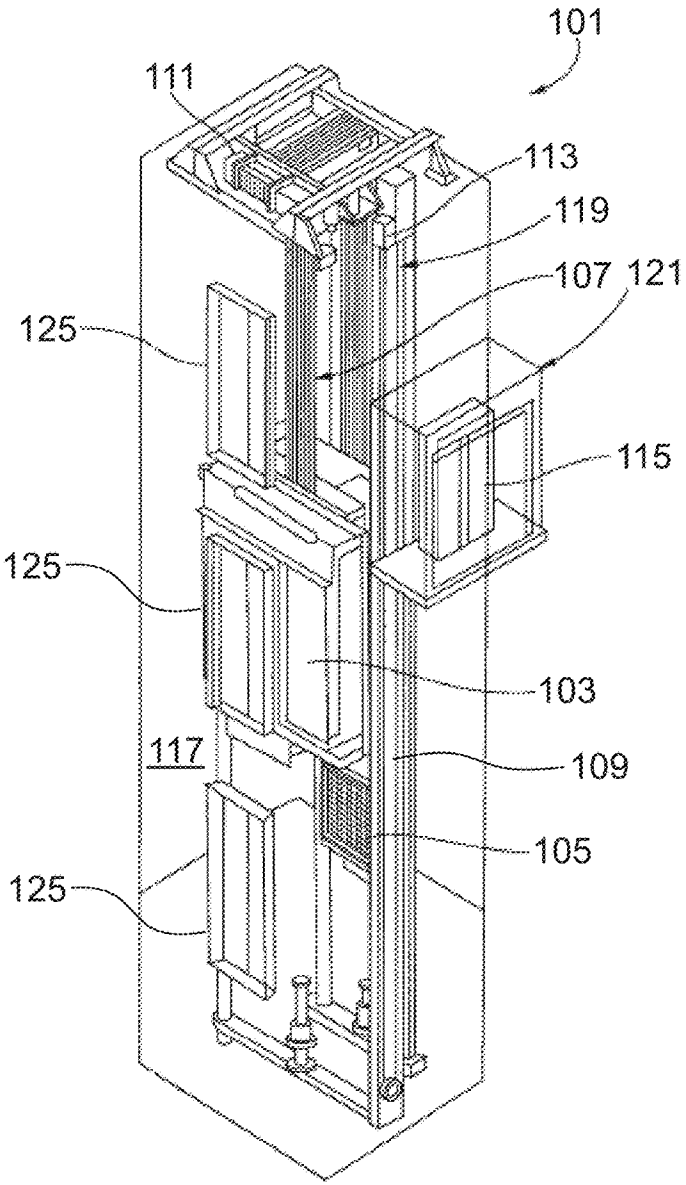
FIG. 1 is a schematic illustration of an elevator system that may employ various embodiments of the disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft, such as hydraulic and/or ropeless elevators, may employ embodiments of the present disclosure. FIG. 1 is merely a non-limiting example presented for illustrative and explanatory purposes.

Figure 2:
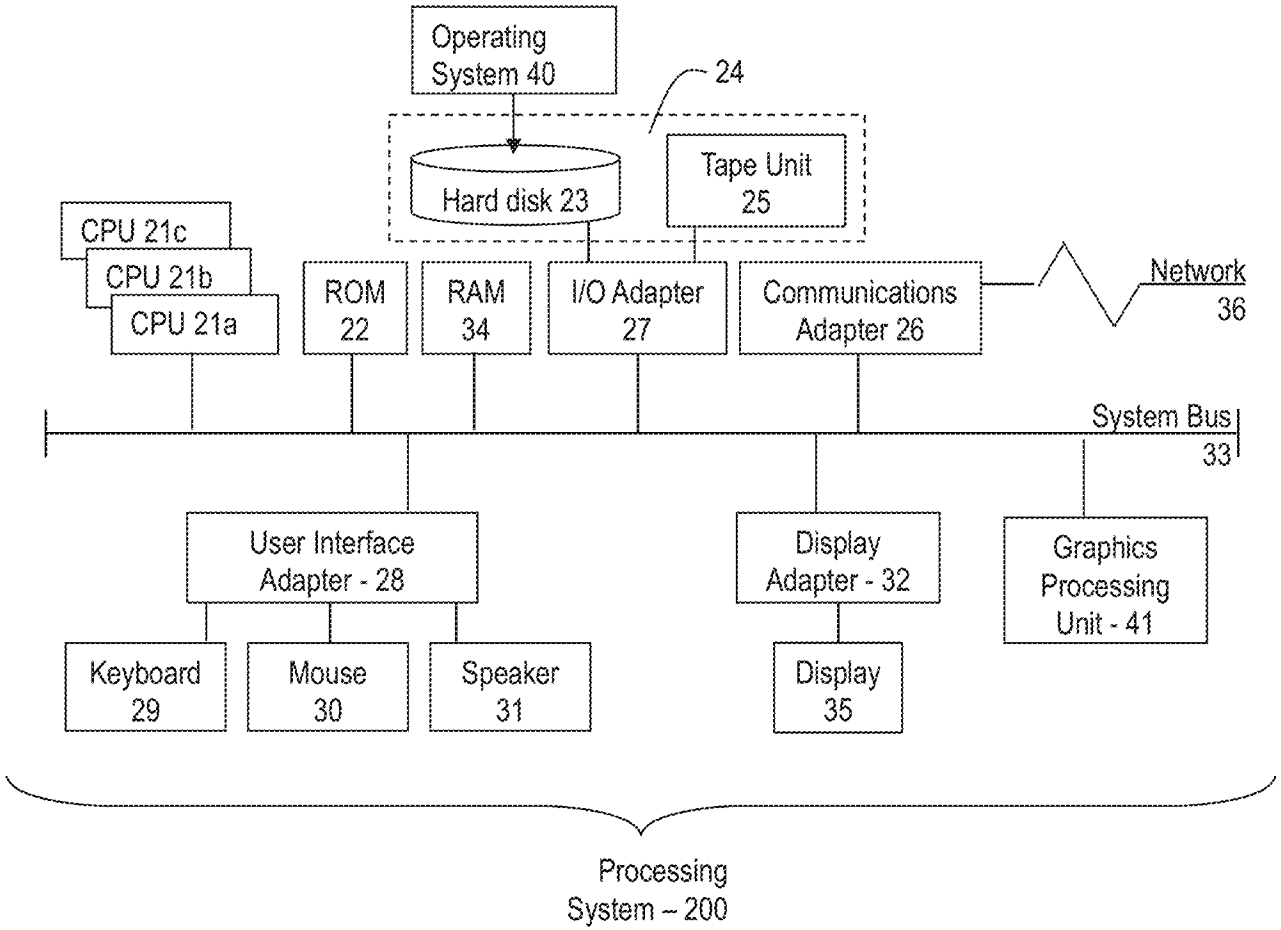
FIG. 2 depicts a block diagram of a computer system for use in implementing one or more embodiments of the disclosure.

Referring to FIG. 2, there is shown an embodiment of a processing system 200 for implementing the teachings herein. In this embodiment, the system 200 has one or more central processing units (processors) 21*a*, 21*b*, 21*c*, etc. (collectively or generically referred to as processor(s) 21). In one or more embodiments, each processor 21 may include a reduced instruction set computer (RISC) microprocessor. Processors 21 are coupled to system memory 34 (RAM) and various other components via a system bus 33. Read only memory (ROM) 22 is coupled to the system bus 33 and may include a basic input/output system (BIOS), which controls certain basic functions of system 200.

FIG. 2 further depicts an input/output (I/O) adapter 27 and a network adapter 26 coupled to the system bus 33. I/O adapter 27 may be a small computer system interface (SCSI) adapter that communicates with a hard disk 23 and/or tape storage drive 25 or any other similar component. I/O adapter 27, hard disk 23, and tape storage device 25 are collectively referred to herein as mass storage 24. Operating system 40 for execution on the processing system 200 may be stored in mass storage 24. A network communications adapter 26 interconnects bus 33 with an outside network 36 enabling data processing system 200 to communicate with other such systems. A screen (e.g., a display monitor) 35 is connected to system bus 33 by display adaptor 32, which may include a graphics adapter to improve the performance of graphics intensive applications and a video controller. In one embodiment, adapters 27, 26, and 32 may be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 33 via user interface adapter 28 and display adapter 32. A keyboard 29, mouse 30, and speaker 31 all interconnected to bus 33 via user interface adapter 28, which may include, for example, a Super I/O chip integrating multiple device adapters into a single integrated circuit.

In exemplary embodiments, the processing system 200 includes a graphics processing unit 41. Graphics processing unit 41 is a specialized electronic circuit designed to manipulate and alter memory to accelerate the creation of images in a frame buffer intended for output to a display. In general, graphics processing unit 41 is very efficient at manipulating computer graphics and image processing and has a highly parallel structure that makes it more effective than general-purpose CPUs for algorithms where processing of large blocks of data is done in parallel. The processing system 200 described herein is merely exemplary and not intended to limit the application, uses, and/or technical scope of the present disclosure, which can be embodied in various forms known in the art.

Thus, as configured in FIG. 2, the system 200 includes processing capability in the form of processors 21, storage capability including system memory 34 and mass storage 24, input means such as keyboard 29 and mouse 30, and output capability including speaker 31 and display 35. In one embodiment, a portion of system memory 34 and mass storage 24 collectively store an operating system coordinate the functions of the various components shown in FIG. 2. FIG. 2 is merely a non-limiting example presented for illustrative and explanatory purposes.

Turning now to an overview of technologies that are more specifically relevant to aspects of the disclosure, typically, in sensor-based elevator performance monitoring, specific tolerance thresholds are set for determining elevator status and operational performance. In certain elevator systems, elevator car performance can vary between one floor and the next floor. For example, an elevator which has a heavier façade door panels in the lobby, but lighter weight door panels on non-lobby floors will exhibit different noise and vibration patterns when the doors open and close. Similarly, in buildings with taller ceiling heights in the lobby versus other non-lobby floors, the travel times will be different. To address these varying performance issues, sensor-based monitoring systems either have to require a tedious user-inputted threshold for each performance condition at each floor, or use wide tolerance bands when determining elevator status and performance. Such wide tolerances could allow some poor performance conditions to pass as acceptable performance for the elevator system or some acceptable performance conditions to be considered poor performance conditions.

Turning now to an overview of the aspects of the disclosure, one or more embodiments address the above-described shortcomings of the prior art by providing a system for establishing elevator system performance thresholds utilizing deep analytics processing of data collected from an onsite sensor. As the data collected from the sensor is processed using analytics, the thresholds for key performance characteristics can be tailored to the specific elevator system and the specific characteristics of particular areas of that elevator system. Once the thresholds are tailored for the elevator system, the onsite sensor can collect key performance attributes when needed for further analytics.

Figure 3:
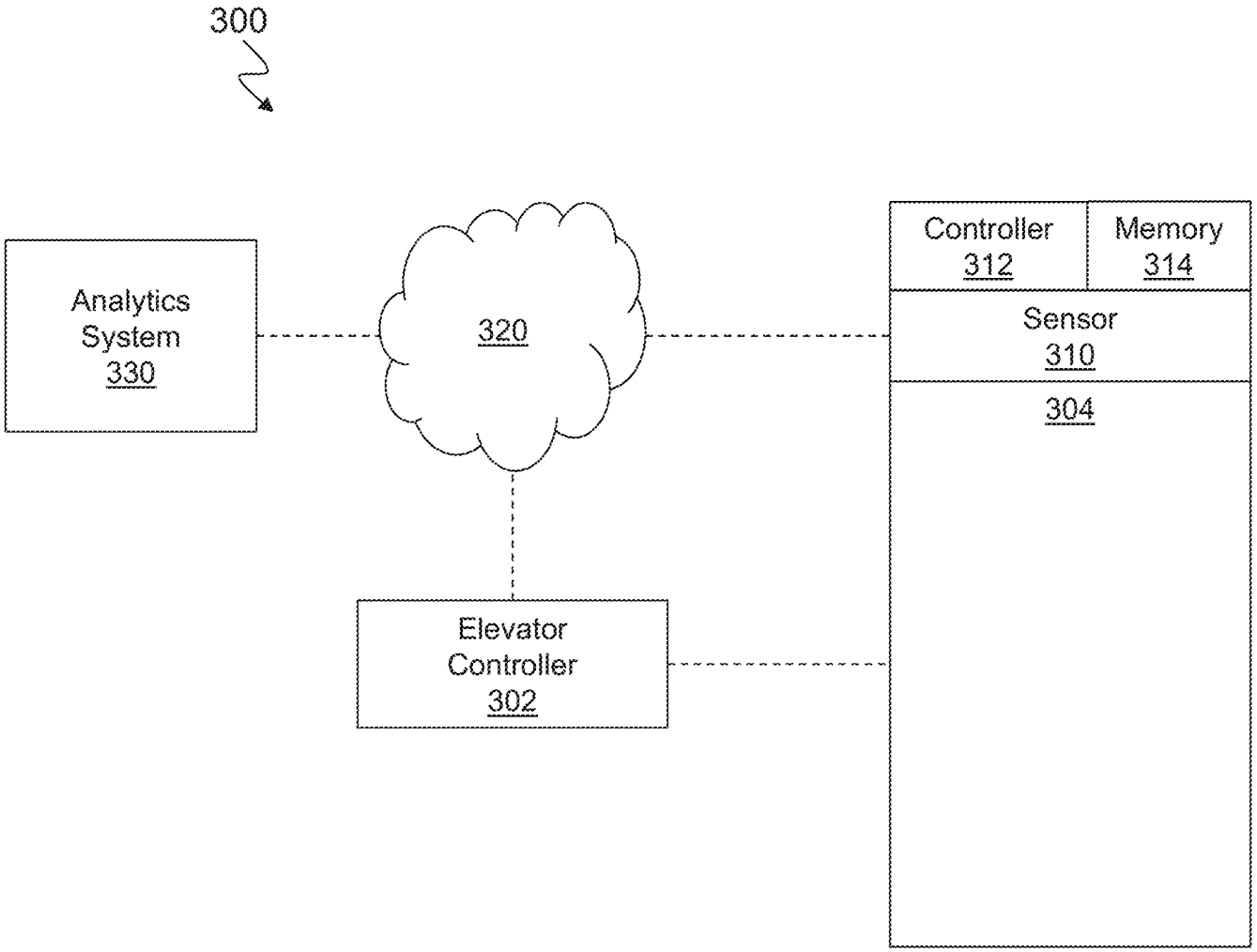
FIG. 3 depicts a block diagram of a system for monitoring thresholds for performance attributes in an elevator system according to one or more embodiments of the disclosure.

Turning now to a more detailed description of aspects of the present disclosure, FIG. 3 depicts a system 300 for monitoring thresholds for performance attributes in an elevator system according to one or more embodiments. The system 300 includes an elevator controller 302, an elevator car 304, a sensor 310 having a controller 312 and memory 314. The system 300 also includes an analytics system 330 accessible via a network 320. In one embodiment, the analytics system 330 may be located in the elevator controller 302, controller 312, or a portable mechanic service tool such as a smartphone, laptop, tablet, etc. In one embodiment, the analytics system 330 may be a remotely located computer or cloud computer.

In one or more embodiments, the elevator controller 302, controller 312, and analytics system 330 can be implemented on the processing system 200 found in FIG. 2. Additionally, a cloud computing system can be in wired or wireless electronic communication with one or all of the elements of the system 300. Cloud computing can supplement, support or replace some or all of the functionality of the elements of the system 300. Additionally, some or all of the functionality of the elements of system 300 can be implemented as a node of a cloud computing system. A cloud computing node is only one example of a suitable cloud computing node and is not intended to suggest any limitation as to the scope of use or functionality of embodiments described herein.

In one or more embodiments, the sensor 310 can be an internet of things (IoT) device. The term Internet of Things (IoT) device is used herein to refer to any object (e.g., an appliance, a sensor, etc.) that has an addressable interface (e.g., an Internet protocol (IP) address, a Bluetooth identifier (ID), a near-field communication (NFC) ID, Zigbee, zWave, WiFi, satellite, etc.) and can transmit information to one or more other devices over a wired or wireless connection. An IoT device may have a passive communication interface, such as a quick response (QR) code, a radio-frequency identification (RFID) tag, an NFC tag, or the like, or an active communication interface, such as a modem, a transceiver, a transmitter-receiver, or the like. An IoT device can have a particular set of attributes (e.g., a device state or status, such as whether the IoT device is on or off, open or closed, idle or active, available for task execution or busy, and so on, a cooling or heating function, an environmental monitoring or recording function, a light-emitting function, a sound-emitting function, etc.) that can be embedded in and/or controlled/monitored by a central processing unit (CPU), microprocessor, ASIC, or the like, and configured for connection to an IoT network such as a local ad-hoc network or the Internet.

In one or more embodiments, the sensor 310 can be affixed to the elevator car 304. The sensor 310 can be affixed to the door header of the elevator car and positioned such that the sensor 310 can collect vibration data as the door of the elevator car 304 opens and closes. In one embodiment, the sensor 310 may be located at any desired location within the elevator system. In one or more embodiments, the sensor 310 includes three accelerometers that can collect movement data in a three dimensional plane defined by an x-axis, y-axis, and z-axis, a single three dimensional accelerometer, or any desired design of accelerometer. This allows the sensor 310 to collect movement data of the elevator car 304, direction data of the elevator car 304, and vibration data when the elevator car 304 is operating and when the doors of the elevator car 304 are cycling. This movement, direction and vibration data (i.e., sensor data) can be stored in the memory 314. In one embodiment, the movement, direction and vibration data (i.e., sensor data) can be stored in the controller 312, elevator controller 302 and/or analytics system 330. In one or more embodiments, the sensor 310 collects sensor data related to performance attributes for the elevator car 304. Performance attributes include, but are not limited to, travel time of elevator car between floors, vibration magnitude/intensity, door cycle times, door vibrations, and any other desired elevator performance statistics. The performance attribute values can indicate normal operation of the elevator car 304 or can indicate abnormal operating conditions that would require maintenance. For example, vibration magnitude of the elevator car 304 that exceeds a certain threshold can indicate that maintenance needs to be performed for safety and passenger experience reasons.

In one or more embodiments, the sensor 310 collects sensor data about the performance attributes of the elevator car 304 and compares the data values to corresponding threshold values stored in a table in memory 314 or in a cloud server or the analytics system 330. In one or more embodiments, the threshold values stored in the table in memory 314 can be preprogrammed from an equipment manufacturer or can be custom programmed by a technician either onsite or offsite. As discussed later herein, the threshold values can be adjusted based on historical sensor data analyzed by a learning algorithm to populate the table with the threshold values. When an elevator car 304 is first installed, the thresholds can be permissive for the performance attributes. In this case, permissive thresholds include a wider range of values for travel times. For example, an initial permissive threshold can be set for a wide performance range and as additional data is collected, the thresholds are reduced and become less permissive. FIG. 4 depicts a threshold profile 400 including thresholds for floor origin-destination pairs according to one or more embodiments. The table 400 includes origin-destination pair travel times for an elevator car in a five story building as a non-limiting example. In each cell of the table, there is an expected travel time and a threshold range associated with the expected travel time. For example, the travel time from the first floor to the fifth floor is expected to be 33 seconds with a threshold range of plus or minus 500 milliseconds of 33 seconds. In one or more embodiments, the threshold profile can include initial, permissive thresholds 402 allowing for a wide range (e.g., 500 ms) outside the expected travel time. During operation of the elevator car 304, the sensor 310 can continue to collect sensor data on the performance attributes (e.g., floor travel time). Periodically, the sensor data can be stored in the memory 314 and transmitted to the analytics system 330 through the network 320. The analytics system 330 can apply deep analytics algorithms (e.g., machine learning, clustering algorithms, etc.) to update the thresholds in the threshold profile 400. In one or more embodiments, the analytics system 330 tunes the threshold profile 400 such that the thresholds become either more or less permissive based on the operation of the elevator car 304. By tuning the thresholds in the threshold profile 400, the sensor data collected from the sensor 310 can become meaningful where the data collected (e.g., exceeding the thresholds) can be more indicative of performance or operational issues of the elevator car. For example, door cycling (e.g., opening and closing) is a performance attribute that causes vibration in the elevator car 304. Certain floors in a building have heavier doors due to cosmetic additions to the door such as in a lobby of a building. The thresholds for vibrations during door cycling in the lobby can have a more permissive threshold due to the weight of the doors. In contrast, the thresholds for other elevator doors outside the lobby can have less permissive thresholds for the vibration magnitude. This tuning allows for more meaningful vibration data being collected because setting the same thresholds for the lobby would cause an alert to be generated more often than on other floors due to the additional weight of the doors.

In one or more embodiments, the threshold profile 400 includes updated thresholds 404 that show a few less permissive thresholds for elevator car travel time between floors. For example, travelling from the fourth floor to the second floor as an expected time of 16 seconds with a threshold range of 16 seconds plus or minus 50 milliseconds. This new threshold range is updated based on stored sensor data periodically obtained from the sensor 310 and analyzed by the analytics system 330. This floor route might be an express route that requires tighter thresholds due to a need for faster and more consistent travel times, such as, for example in a hospital between two associated practice groups. In this example, tighter thresholds are needed to ensure better performance.

In one or more embodiments, the analytics system 330 can utilize any type of analytics to process the sensor data and update the threshold profile. The analytics can include statistical analysis of the sensor data including performance attribute values to obtain distributions of the data such as a normal distribution. Further analytics can establish standard deviations on the performance attribute values to determine standard deviations and the threshold ranges can be multipliers of the standard deviations (e.g., 1 standard deviation, 2 standard deviations). In one or more embodiments, clustering algorithms and machine learning algorithms can be used to process the performance attribute values to establish thresholds. For example, one performance attribute can be vibration magnitude which would not fall within a threshold range but, instead, into a maximum threshold value. For any sensor values that exceed the maximum threshold value, an alert can be generated and transmitted to a monitoring system (e.g., maintenance). The vibration in the elevator system can be measured in 3 axis by the accelerometer (sensor). An initial ride or an average of rides during early stages after installation can be utilized as values for later comparison. Amplitude of vibration can be measured in all 3 axis at multiple frequencies at multiple positions in the hoistway. Also, for elevator door movement, the amplitude of vibration of car door can be measured in all 3 axis at multiple frequencies at multiple positions in the hoistway (floors) and at multiple position of the door (movement).

In one or more embodiments, calculating a threshold can be achieved by collecting a normal distribution for each of the events or events clustering to define the most optimum value of the threshold. For example, having a large number of measurements of ride time from floor to floor allows for defining the most probable time of the travel under various conditions and distribution of the times will help to understand what kind of tolerances are needed to apply to that measurement to address worst and best scenarios. (e.g., thresholds) Deep learning and neural networks can be utilized to learn the "signatures" of each of the events. Also, with enough training data, a machine learning model can be developed.

In one or more embodiments, algorithms can work with less precise measurements (e.g., larger tolerances) and learning the events signatures can be utilized to narrow down the tolerances and more precisely tune the performance of the system. For example, the time between door operation on one floor and the time of door operation on another floor can increase and potentially this can indicate excessive releveling on one of the floors or issue with door operation timing, or control system problem that causes delays due to longer pre-torqueing of the system.

In one or more embodiments, when the performance attribute values from the sensor data exceed a threshold, the controller 312 transmits an alert to a monitoring system, maintenance personnel, and the like. The alert can be transmitted each time a threshold is exceeded or can be sent in batches periodically that include multiple threshold violations. The alert can include the performance attribute value (e.g., travel time, vibration magnitude) along the current and/or historical thresholds. The type of alert transmitted can be based on the performance attribute value exceeding the threshold by a certain amount. For example, performance attribute values exceeding the threshold by a small amount can generate a minor alert. A performance attribute value exceeding the threshold by a larger amount can generate a more severe alert to a monitoring system or maintenance personnel. In one embodiment, the alert may be transmitted by the elevator controller 302 or analytics system 330.

In one or more embodiments, the analytics system 330 and the controller 312 can communicate with the elevator controller 302 either directly or through the network 320. When a threshold for a performance attribute is exceeded, the elevator controller 302 can cause the elevator car 304 to change an operating condition. For example, if the vibration data collected while the elevator doors are cycling exceeds the threshold, the controller 312 can transmit an alert to the elevator controller 302 which can in turn cause the doors to open and close slower to address the vibration. Another example, if the travel time threshold is exceeded, the controller 312 can transmit the alert to the elevator controller 302 to cause the elevator car 304 to reduce speed. In addition, the analytics system 330 can determine certain trends in performance of the elevator car 304 based on the historical sensor data and transmit instructions for the elevator controller 302 to alter operation of the elevator car 304. For example, vibration data might indicate an issue with an elevator rail between certain floors of the building and the elevator controller 302 can slow the elevator car 304 while passing the parts of the rail causing the vibration and then resume normal speed after passing the problematic parts of the rail.

Figure 5:
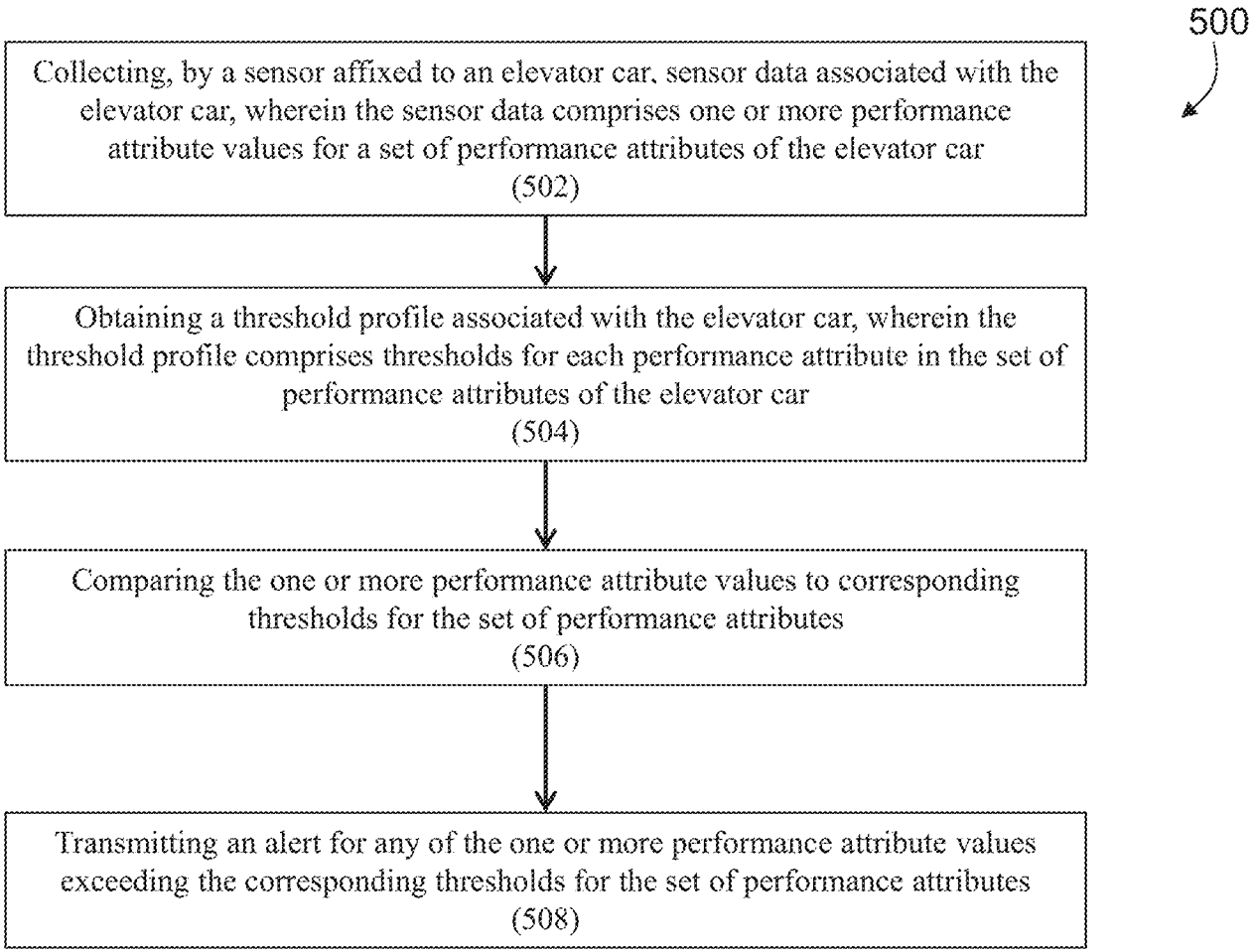
FIG. 5 depicts a flow diagram of a method for monitoring thresholds for performance attributes in an elevator system according to one or more embodiments of the disclosure.

FIG. 5 depicts a flow diagram of a method for monitoring thresholds for performance attributes in an elevator system according to one or more embodiments. The method 500 includes collecting, by a sensor affixed to an elevator car, sensor data associated with the elevator car, wherein the sensor data comprises one or more performance attribute values for a set of performance attributes of the elevator car, as shown in block 502. At block 504, the method 500 includes obtaining a threshold profile associated with the elevator car, wherein the threshold profile comprises thresholds for each performance attribute in the set of performance attributes of the elevator car. The method 500, at block 506, includes comparing the one or more performance attribute values to corresponding thresholds for the set of performance attributes. And at block 508, the method 500 includes transmitting an alert for any of the one or more performance attribute values exceeding the corresponding thresholds for the set of performance attributes.

Additional processes may also be included. It should be understood that the processes depicted in FIG. 5 represent illustrations and that other processes may be added or existing processes may be removed, modified, or rearranged without departing from the scope and spirit of the present disclosure.

In one or more embodiments, when certain thresholds are being reached, the elevator system may need to change the resolution or method of collecting the data (frequency) to confirm certain events/crossing of the thresholds with greater detail. This can be based on a dependency of threshold between different measurements.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A method for monitoring thresholds for performance attributes in an elevator system, the method comprising:

collecting, by a sensor affixed to an elevator car, sensor data associated with the elevator system wherein the sensor data comprises one or more performance attribute values for a set of performance attributes of the elevator system;

obtaining a threshold profile associated with the elevator system, wherein the threshold profile comprises thresholds for each performance attribute in the set of performance attributes of the elevator system;

comparing the one or more performance attribute values to corresponding thresholds for the set of performance attributes; and transmitting an alert for any of the one or more performance attribute values exceeding the corresponding thresholds for the set of performance attributes;

storing, in a memory, the sensor data;

periodically, analyzing the stored sensor data to update the threshold profile.

2. The method of claim 1, wherein the thresholds for each performance attribute varies based on a floor location of the elevator system.

3. The method of claim 1, wherein the thresholds comprise a range of values for each of the set of performance attributes of the elevator car.

4. The method of claim 1, wherein the thresholds comprise a single value for each of the set of performance attributes of the elevator car.

5. The method of claim 1, wherein the alert includes any of the one or more performance attribute values exceeding the corresponding thresholds for the set of performance attributes and the corresponding thresholds.

6. The method of claim 4, wherein the alert is transmitted to an elevator maintenance system.

7. The method of claim 1 further comprising causing an action for the elevator car to occur based at least in part on any of the one or more performance attribute values exceeding the corresponding thresholds for the set of performance attributes.

8. The method of claim 1, wherein the action comprises altering an operation of the elevator car.

9. The method of claim 1, wherein at least one of the set of performance attributes includes travel time for an elevator car in the elevator system.

10. The method of claim 1, wherein at least on one of the set of performance attributes includes elevator system door vibration; and further comprising:

collecting, by the sensor, vibration values associated with an elevator car in the elevator system;

comparing the vibration values to a threshold from the threshold profile; and adjusting an opening speed for an elevator system door based at least in part on the vibration values exceeding the threshold.

11. A method for monitoring thresholds for performance attributes in an elevator system, the method comprising:

collecting, by a sensor affixed to an elevator car, sensor data associated with the elevator system wherein the sensor data comprises one or more performance attribute values for a set of performance attributes of the elevator system;

obtaining a threshold profile associated with the elevator system, wherein the threshold profile comprises thresholds for each performance attribute in the set of performance attributes of the elevator system;

comparing the one or more performance attribute values to corresponding thresholds for the set of performance attributes;

transmitting an alert for any of the one or more performance attribute values exceeding the corresponding thresholds for the set of performance attributes;

wherein the thresholds for each performance attribute varies based on a floor location of the elevator system;

storing, in a memory, the sensor data;

periodically, analyzing the stored sensor data to update the threshold profile wherein analyzing the stored sensor data to update the threshold profile comprises:

applying a learning algorithm to the stored sensor data to extract updated thresholds for each of the set of performance attributes; and storing the updated thresholds in the threshold profile.

12. An elevator system comprising:

an elevator car;

a sensor affixed to the elevator car, wherein the sensor is operated by a controller; and wherein the controller is configured to:

collect, by the sensor, sensor data associated with the elevator system, wherein the sensor data comprises one or more performance attribute values for a set of performance attributes of the elevator system;

obtain a threshold profile associated with the elevator system, wherein the threshold profile comprises thresholds for each performance attribute in the set of performance attributes of the elevator system;

compare the one or more performance attribute values to corresponding thresholds for the set of performance attributes;

transmit an alert for any of the one or more performance attribute values exceeding the corresponding thresholds for the set of performance attributes;

store, in a memory, the sensor data;

periodically, analyze the stored sensor data to update the threshold profile.

13. The elevator system of claim 12, wherein the thresholds for each performance attribute varies based on a floor location of the elevator system.

14. The elevator system of claim 13, wherein the thresholds comprise a range of values for each of the set of performance attributes of the elevator car.

15. The elevator system of claim 12, wherein the thresholds comprise a single value for each of the set of performance attributes of the elevator car.

16. The elevator system of claim 12, wherein the alert includes any of the one or more performance attribute values exceeding the corresponding thresholds for the set of performance attributes and the corresponding thresholds.

17. An elevator system comprising:

an elevator car;

a sensor affixed to the elevator car, wherein the sensor is operated by a controller; and wherein the controller is configured to:

collect, by the sensor, sensor data associated with the elevator system, wherein the sensor data comprises one or more performance attribute values for a set of performance attributes of the elevator system;

obtain a threshold profile associated with the elevator system, wherein the threshold profile comprises thresholds for each performance attribute in the set of performance attributes of the elevator system;

compare the one or more performance attribute values to corresponding thresholds for the set of performance attributes;

transmit an alert for any of the one or more performance attribute values exceeding the corresponding thresholds for the set of performance attributes;

wherein the thresholds for each performance attribute varies based on a floor location of the elevator system;

wherein the controller is further configured to:

store, in a memory, the sensor data; and periodically, analyze the stored sensor data to update the threshold profile;

wherein analyzing the stored sensor data to update the threshold profile comprises:

applying a learning algorithm to the stored sensor data to extract updated thresholds for each of the set of performance attributes; and storing the updated thresholds in the threshold profile.

18. The elevator system of claim 17, wherein the alert is transmitted to an elevator maintenance system.

* * * * *